United States Patent [19]

Kirchhof

[11] Patent Number: 5,009,526

[45] Date of Patent: Apr. 23, 1991

[54] METHOD OF ADJUSTING A PRINTING GAP IN A PRINTER

[75] Inventor: Rolf Kirchhof, Freusburg, Fed. Rep. of Germany

[73] Assignee: U.S. Philips Corporation, New York, N.Y.

[21] Appl. No.: 508,034

[22] Filed: Apr. 10, 1990

[30] Foreign Application Priority Data

Apr. 21, 1989 [DE] Fed. Rep. of Germany ..... 3913073

[51] Int. Cl.[5] ..... B41J 25/28

[52] U.S. Cl. ..... 400/56; 400/59

[58] Field of Search ..... 400/55, 56, 57, 59, 400/124; 101/93.03, 93.05

[56] References Cited

U.S. PATENT DOCUMENTS

| | | | |
|---|---|---|---|
| 3,983,803 | 10/1976 | Thomas et al. | 400/56 |
| 4,173,927 | 11/1979 | Kemen et al. | 400/56 |
| 4,174,908 | 11/1979 | Wehler | 400/56 |
| 4,233,895 | 11/1980 | Wehler | 400/56 |
| 4,812,059 | 3/1989 | Masaki | 400/59 |
| 4,881,835 | 11/1989 | Nilkawa | 400/56 |
| 4,886,380 | 12/1989 | Chu | 400/56 |
| 4,893,949 | 1/1990 | Limberger et al. | 400/59 |
| 4,897,670 | 1/1990 | Hasegawa et al. | 400/55 |
| 4,917,512 | 4/1990 | Mimura et al. | 400/56 |

FOREIGN PATENT DOCUMENTS

| | | | |
|---|---|---|---|
| 0071375 | 3/1988 | Japan | 400/56 |

*Primary Examiner*—Eugene H. Eickholt

*Attorney, Agent, or Firm*—William Squire

[57] ABSTRACT

A print head is moved to and fro between two direction reversing points along a print support and simultaneously moved forward toward the print support until the head engages the support. The engagement of the head with the support produces a variable parameter in response to the to and fro reciprocating movement. When the parameter reaches a given value indicating engagement of the head and support, the forward movement of the head is stopped, and the print head, starting from this position, in which the gap between the head and support is zero, is moved in the reverse direction away from the support to the desired gap value.

15 Claims, 1 Drawing Sheet

METHOD OF ADJUSTING A PRINTING GAP IN A PRINTER

The invention relates to a method of adjusting a print gap in a printer.

Of interest is copending application Ser. No. 288,539 entitled "Device for Adjusting the Distance Between a Platen and a Printer" filed Dec. 21, 1988 in the name of M. Adamek and assigned to the assignee of the present invention.

The printing gap in a needle printer is defined as the free distance between the ink ribbon engaging the printing head and the paper engaging the printing support. New high-performance printing heads operating at needle frequencies lying between 2 and 3 kHz impose stringent requirements on the maintenance of the given printing gap in order that the required printing quality and these needle frequencies can be realized.

It is known to adjust the printing gap by hand mechanically. Further, an electromechanical adjustment and an automatic permanent regulation of the printing gap are known. The known adjustment methods and adjustment devices have the disadvantage that they are user-unfriendly, complicated and very inaccurate and fail with problematic forms or do not admit an automatic processing of different form thicknesses.

The invention has for its object to provide for a needle printer having multiple paper supply possibilities and also permanently changing form thicknesses via an inexpensive and accurate adjustment of the printing gap. According to the invention, this object is achieved in that the printing head is moved several times to and fro between two switching points and is at the same time moved forwards in the direction of the printing roller, in that the contact between the roller and the printing head is determined by variation of a parameter characteristic of the reciprocating movement, in that this variation results, when a given value is reached, in stopping of the forward movement, and in that, starting from this position, in which the printing gap is at "zero", the printing head is moved backwards by the desired value of the printing gap. The method permits an exact adjustment with high reproducibility and requires little effort because resource can be made to present assemblies. For example, no complicated path or force sensor is required. Since the contact between the printing support and the printing head is determined immediately, a small pressure force is obtained when the printing head collides with the printing support so that no undesired elastic deformations in the printing mechanism can occur, which falsify the measuring process.

Preferably, as a characteristic parameter the time is used required by the printing head for the reciprocating movement between two switching points, the average time required by the printing head for this measurement path being determined from several movement cycles. It is also possible to use as a characteristic parameter the current-or voltage values consumed by the motor for producing the reciprocating movement. For producing the reciprocating movement, use is preferably made of a direct current motor drive of the printing carriage already present in the printer and of an incremental linear scanning device likewise already present having a stationary increment ruler and a scanning element at the printing carriage. For producing the forward and backward movement, use is preferably made of a stepping motor together with an eccentric guiding shaft for the printing carriage. The method according to the invention can therefore be carried out mainly with elements already present. For adjustment, the printing head is moved slowly by the stepping motor towards the printing support. At the same time, the horizontal drive by the direct current motor is in operation, for example its current consumption and/or speed being measured. When the printing head touches the paper, the current consumption increases and the speed decreases by the additional friction in the horizontal drive. These variations can be evaluated, for example, by means of threshold-value switches. When these switches respond, the printing gap has the value zero. Subsequently, the printing head is moved back by a number of steps corresponding to the desired printing gap and the printing gap is adjusted to the desired value. When processing different forms, the corresponding scanning value for each kind of form can be stored and according to need the stepping motor can therefore be directly driven.

A device for carrying out the method according to the invention therefore preferably comprises a direct current motor for the horizontal drive of the printing carriage, an incremental linear scanning device having a stationary increment ruler and a scanning element provided at the carriage, a stepping motor for forward and backward movement of the carriage with the printing head and an electronic system for controlling the reciprocating movement or the forward and backward movement of the carriage and for determining the printing gap of "zero" when the characteristic parameter has reached a given value.

FIGS. 1 to 3 of the drawing show an embodiment of the device according to the invention.

Figure 1:
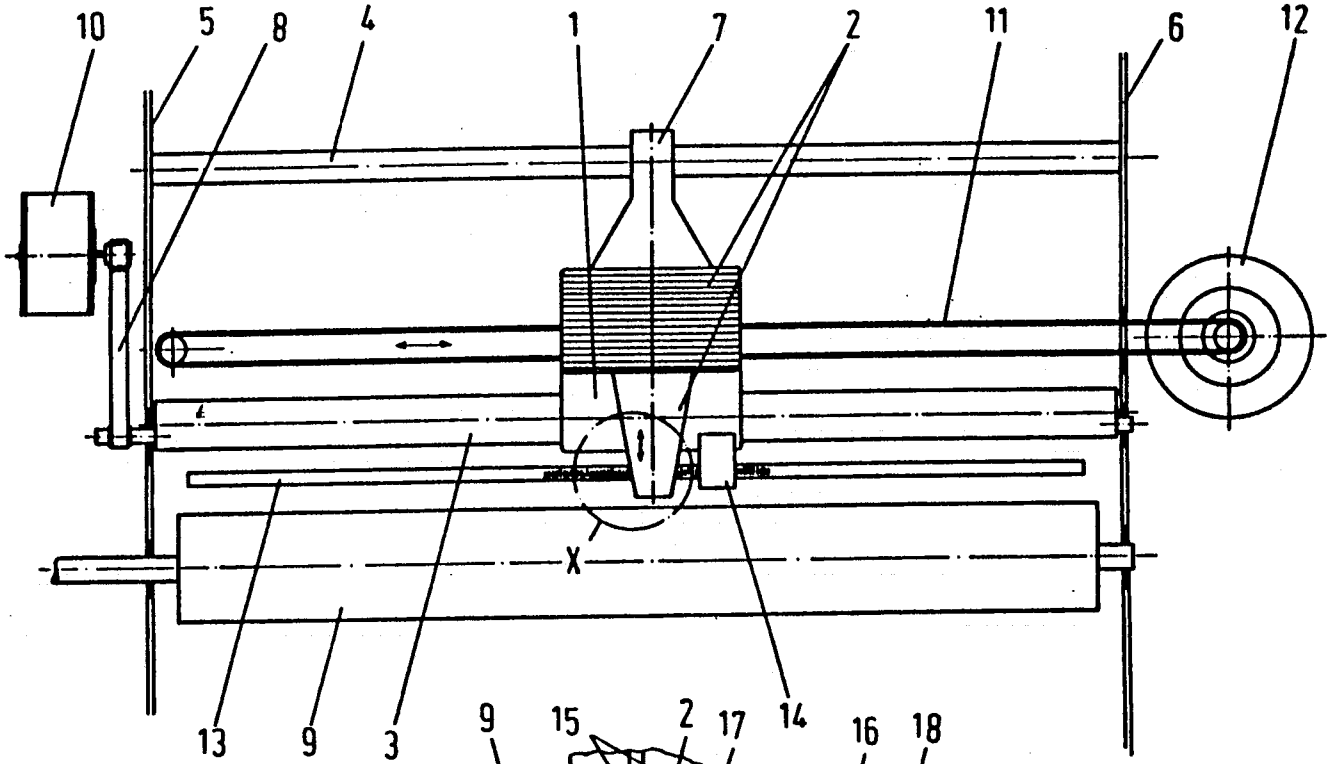
FIG. 1 is a plan view of a printer.
Figure 2:
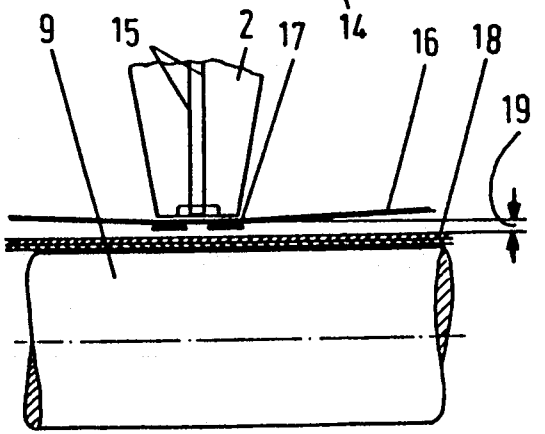
FIG. 2 shows a detail X according to FIG. 1.

A printing-head carriage 1 with a printing head 2 runs over two parallel circular guides 3, 4. The foremost guide 3 is journalled in side walls 5, 6 so as to be eccentrically rotatable. A hindmost bearing 7 is in the form of a step bearing and permits a displacement of the printing carriage 1 at right angles to the hindmost shaft 4. The eccentric shaft 3 is provided with a toothed segment 8, by which the shaft can be rotated. The eccentric is aligned so that upon rotation a movement of the printing head 2 is obtained at right angles to the printing support, i.e. to the printing roller 9. By means of a stepping motor 10, which meshes with the toothed segment 8, the printing gap 19 can therefore be electrically adjusted. The carriage 1 is driven through a toothed belt 11 by a direct current horizontal motor 12. For speed measurement and character editing, use is made of an incremental linear scanning device having a stationary increment ruler 13 and a scanning element 14 at the carriage 1. Reference numeral 15 designates needles of the printing head 2. The ink ribbon 16 is covered by a diaphragm 17 so that a direct contact between ink ribbon and paper is prevented. The needles 15 press through an opening in the diaphragm 17 on the paper 18. Reference numeral 19 designates the printing gap formed between the paper 18 and the ink ribbon 16.

The scanning operation is effected as follows: At the beginning of the operation, the carriage 1 occupies a horizontal position in the printing area and the printing head 2 is pivoted away. Subsequently, the horizontal motor 12 is driven with a reduced constant current or a reduced constant voltage. The carriage 1 with the head 2 then moves in the horizontal direction and is reversed, for example, each time after a distance of 1 to 5/120 inch so that a reciprocating movement is obtained. The measurement path moves, for example, between two adjacent vertical sections 13*a* and 13*b* of the increment ruler 13 (see FIG. 3). The average time $t_m$, which is required by the printing head 2 for the measurement path 20, is determined from several movement cycles. Simultaneously with this reciprocating movement, the printing head 2 is moved slowly in comparison with the reciprocating movement by the stepping motor 10 in the direction of the paper 18. As soon as the time $t_m$ for passage through the measurement path 20 increases by a given predetermined factor, this value is considered as an indication that the printing gap 19 has reached the value "zero" and the forward movement of the printing head 2 is stopped. Subsequently, the stepping motor 10 moves back by the desired steps required for the adjustment of the desired printing gap 19.

Figure 3:
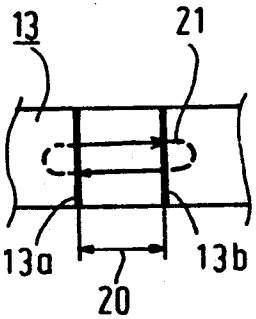
FIG. 3 shows a further detail according to FIG. 1.

FIG. 3 shows diagrammatically the measurement path between two increment sections 13*a* and 13*b* of the increment ruler 13. The length of the measurement path is designated by reference numeral 20. The reversal of the direction of movement takes place each time at the ends of the measurement path. Reference numeral 21 designates diagrammatically in broken lines the path of the printing head 2 after turn-off. As can be seen, the printing head 2 moves after turn-off each time still over a given path beyond the boundaries 13*a*, 13*b* before the reversal takes place.

What is claimed is:

1. A method of adjusting a printing gap in a printer between a printing head and a printing support comprising:

(a) moving the printing head to and fro in first reciprocating directions between direction switching points and then simultaneously moving the head forwards in a second direction toward the printing support to contact the support, (b) determining the variation of a parameter characteristic value of the reciprocating to and fro movement caused by contact of the printing head with the printing support, (c) said variation results, when a given characteristic value is reached, in stopping the forward movement, and (d) moving the printing head, starting from this stopped forward movement position, in which the printing gap is at "zero", backwards a desired value of the printing gap.

2. A method as claimed in claim 1, wherein the characteristic parameter is the time required by the printing head for the reciprocating movement between the two switching points, the average time required by the printing head for this movement being determined from several movement cycles.

3. A method as claimed in claim 1 wherein a direct current motor causes said reciprocating movement, the characteristic parameter being one of the current—or voltage value consumed by the direct current motor for producing the reciprocating movement.

4. A method as claimed in claim 1 wherein a direct current motor causes said reciprocating movement, said motor causing movement of a printing carriage carrying said head in said first directions, said printer including an incremental linear scanning device having a stationary increment ruler and a scanning element provided at the carriage, said method including scanning said ruler to determine said switching points.

5. A method as claimed in claim 1 in that a stepping motor produces the forward and backward movement of the printing head.

6. A method as claimed in claim 2 wherein a direct current motor causes said reciprocating movement, said motor causing movement of a printing carriage carrying said head in said first directions, said printer including an incremental linear scanning device having a stationary increment ruler and a scanning element provided at the carriage, said method including scanning said ruler to determine said switching points.

7. A method as claimed in claim 3 wherein a direct current motor causes said reciprocating movement, said motor causing movement of a printing carriage carrying said head in said first directions, said printer including an incremental linear scanning device having a stationary increment ruler and a scanning element provided at the carriage, said method including scanning said ruler to determine said switching points.

8. A method as claimed in claim 2 in that a stepping motor produces the forward and backward movement of the printing head.

9. A method as claimed in claim 3 in that a stepping motor produces the forward and backward movement of the printing head.

10. A method as claimed in claim 4 in that a stepping motor produces the forward and backward movement of the printing head.

11. A method as claimed in claim 6 in that a stepping motor produces the forward and backward movement of the printing head.

12. A method as claimed in claim 7 in that a stepping motor produces the forward and backward movement of the printing head.

13. A device for adjusting the gap between a print head and a print support comprising:

motor means for driving the print head along the support in reciprocating first directions;

incremental scanning means coupled to said head and support responsive to the reciprocating movement of the head for providing a displacement signal manifesting the displacement of the head;

means for displacing the head toward and away from the support to produce a characteristic parameter signal in response to the engagement of the head with the support; and electronic control means responsive to said displacement signal for controlling said reciprocating displacement and to said characteristic parameter signal for adjusting the gap to a predetermined value when the parameter signal has a given value.

14. The device of claim 13 wherein said motor means includes a direct current motor for driving the print head in said first directions and said means for displacing the head includes a stepping motor for moving the print head to produce said parameter signal.

15. The device of claim 13 wherein said electronic means includes means for stopping the displacement of the head when it engages the support and for reversing the movement of the head until the desired gap between the head and support is reached.

* * * * *